US005347829A

United States Patent [19]

Newman

[11] Patent Number: 5,347,829

[45] Date of Patent: Sep. 20, 1994

[54] AIR CONDITIONING SYSTEM ACCUMULATOR WITH INTERNAL DRAIN DOWN PROTECTION

[75] Inventor: Kenneth B. Newman, Dayton, Ohio

[73] Assignee: General Motors Corporation, Detroit, Mich.

[21] Appl. No.: 148,236

[22] Filed: Nov. 8, 1993

[51] Int. Cl.[5] ..... F25B 43/00

[52] U.S. Cl. ..... 62/474; 62/503

[58] Field of Search ..... 62/503, 474

[56] References Cited

U.S. PATENT DOCUMENTS

| | | | |
|---|---|---|---|
| 3,012,414 | 12/1961 | La Porte | 62/503 X |
| 4,633,679 | 1/1987 | Wintersteen | 62/474 |
| 4,675,971 | 6/1987 | Masserang | 29/422 |
| 5,179,844 | 1/1993 | Lyman et al. | 62/503 |
| 5,184,479 | 2/1993 | Koberstein et al. | 62/503 |

OTHER PUBLICATIONS

Filed Oct. 1 1993 U.S. Ser. No. 130,399–Bottom Outlet Accumulator Dehydrator with Improved Feed Toomy Lee Lyman & Douglas Charles Wintersteen.

*Primary Examiner*—William E. Wayner

*Attorney, Agent, or Firm*—Patrick M. Griffin

[57] ABSTRACT

A bottom outlet type air conditioning accumulator canister avoids the drain down problem inherent with bottom outlets by providing an internal return tube that has two complete loops, including three legs and an upper and lower bight. A bleed hole assembly for aspirating out collected liquid is located in the lower bight, while the upper bight prevents drain down through the bleed hole when the system sits idle. The upper bight is also located just below the upper end of the return tube, so that a pair of saddle bag style desiccant pouches can be hung over the upper tube end and rest on the upper bight.

3 Claims, 3 Drawing Sheets

AIR CONDITIONING SYSTEM ACCUMULATOR WITH INTERNAL DRAIN DOWN PROTECTION

This invention relates to vehicle air conditioning system accumulator/dehydrator assemblies in general, and specifically to such an assembly that has internal, integral protection against leak down into the compressor outlet line.

BACKGROUND OF THE INVENTION

Vehicle air conditioning systems include a compressor that compresses and superheats refrigerant vapor, which then runs through a condenser, expander and evaporator in turn before returning to the compressor to begin the cycle again. The output of the evaporator includes more than just refrigerant, carrying a component of lubricating oil and some small amount of water, all three of which are in a vapor-liquid mixture. Interposed between the evaporator and compressor is a so called accumulator, also known as an accumulator dehydrator or simply A/D, which is designed to accomplish several objectives. Primarily, the so called A/D operates as its name would suggest, receiving and accumulating the evaporator output and serving as a reservoir or separator in which liquid collects at the bottom and vapor at the top. A return tube internal to the canister has an open inlet located near the canister top end. The canister suction line is connected to an outlet end of the return tube, so that the compressor draws primarily vapor, through the return tube inlet. However, the accumulated liquid also has to be drawn out, since it will not vaporize quickly enough to simply be drawn out from the vapor space at the top of the canister. To draw down the accumulated liquid, a bleed hole assembly, consisting of a small hole in the return tube and a surrounding filter screen, is located on the return tube, near the canister bottom end. As suction is applied to the return tube, accumulated liquid, both the refrigerant and oil component, is aspirated through the bleed hole.

The shape of the return tube varies depending on where its outlet can be located. Ideally, the return tube outlet can be placed high in the canister, near the upper end. This allows the return tube to have a U shape, with the bleed hole assembly located at the bottom bend in the U. Then, there is a built in trap to prevent accumulated liquid from draining down into the compressor suction line when the compressor is off for extended periods. This can cause so called "slugging," undesirable noise when the compressor is turned on again. Sometimes, under hood packaging and line routing considerations dictate that the return tube be a single straight length of tube that runs directly out the bottom end of the canister. In that case, it has been necessary to put a so called J bend in the compressor suction line itself, external to the canister, to act as a trap to prevent leak down. There are circumstances where there is no room for an external J trap, either. In any case, an internal leak down prevention mechanism would be simpler to install in cases where a bottom outlet canister type A/D was required. Another consideration in canister type A/D design is water vapor separation. The canister represents a convenient location for bags of water vapor desiccant. Many simple A/D designs, that is, those that use simple bags of desiccant, only have room for the bags at or near the canister bottom, right within the collected liquid pool, and often require a separate fastener to hold the bag or bags in place.

SUMMARY OF THE INVENTION

The invention provides a bottom outlet A/D with a simple leak down prevention mechanism that is entirely internal to the canister. In addition, a simple desiccant bag arrangement is provided which works in cooperation with the leak down prevention mechanism.

In the embodiment disclosed, the basic structure is a cylindrical canister, vertically oriented with top and bottom ends. The internal return tube is a one piece, continuous tube of complex shape, which is uniquely packed within the limited canister internal volume. The canister interior is divided lengthwise into four equal quadrants, for purposes of space efficiency, and the return tube is run through all four quadrants in a special, closely packed arrangement. The return tube begins at an open inlet end near the canister top end, runs in a first, initial leg down through a first quadrant to lower bight that crosses over to a second quadrant, from which a second, transition leg runs up and across to a third quadrant to an upper bight located just below the inlet end that crosses over to a fourth quadrant, then back down in a third, final leg through the fourth quadrant and exiting through the canister bottom end. The bleed hole assembly is mounted on the lower bight, which puts it near the bottom of the liquid reservoir. When the compressor is on, therefore, vapor is drawn from the top of the canister, through the inlet end, and liquid refrigerant and oil is aspirated through the bleed hole assembly. When the compressor is off, the upper bight prevents liquid from draining down through the bottom outlet. The upper bight serves another function, in the embodiment disclosed. The upper bight is located just below the return tube inlet end. A pair of desiccant bags, is hung saddle bag style, over the inlet end an on the upper bight. They hang in the canister vapor space, with no separate fastener necessary.

DESCRIPTION OF THE PREFERRED EMBODIMENT

These and other features of the invention will appear from the following written description, and from the drawings, in which.

Figure 1:
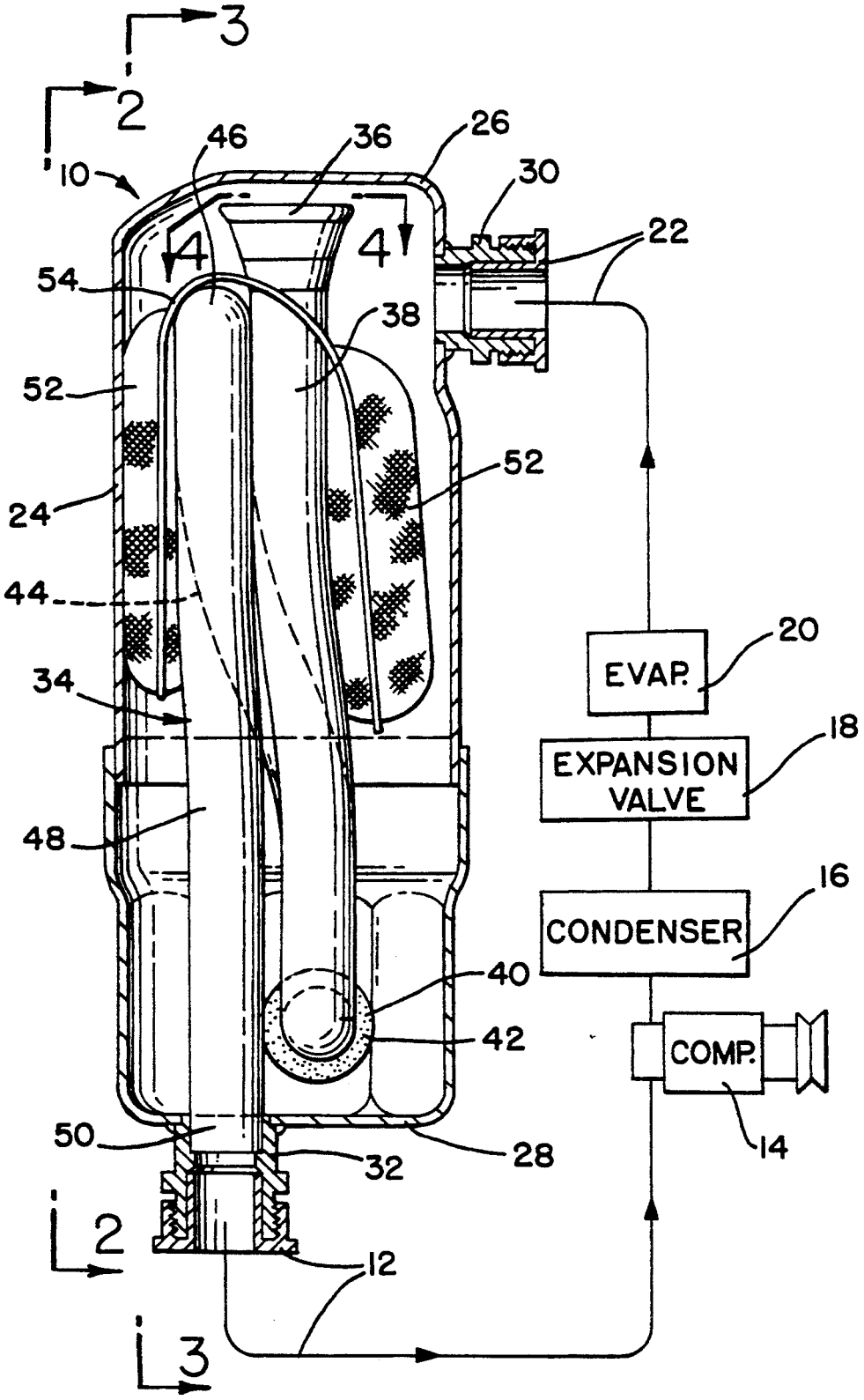
FIG. 1 is a cross section of a canister type A/D incorporating the invention, showing the internal return tube in elevation and shows other components of the refrigerant cycle schematically.

Referring first to FIG. 1, a preferred embodiment of the invention, indicated generally at 10, is part of a standard vehicle air conditioning system or refrigerant cycle, which includes, in series, a suction line 12 running to compressor 14, a condenser 16, expansion valve 18, evaporator 20, and evaporator line 22. The output of evaporator 20 can best be described as a mixture, a mixture of mostly refrigerant, a significant measure of entrained lubricating oil, and some water contaminant. All three components exist in both liquid and vapor form, as well. In addition, some particulate solid contaminants can enter the flow. It is preferable that all inputs to compressor 14 be in vapor form, or, if liquid, in fine droplets or mist. The invention is intended to assure that condition, as well as providing other advantages.

Figure 4:
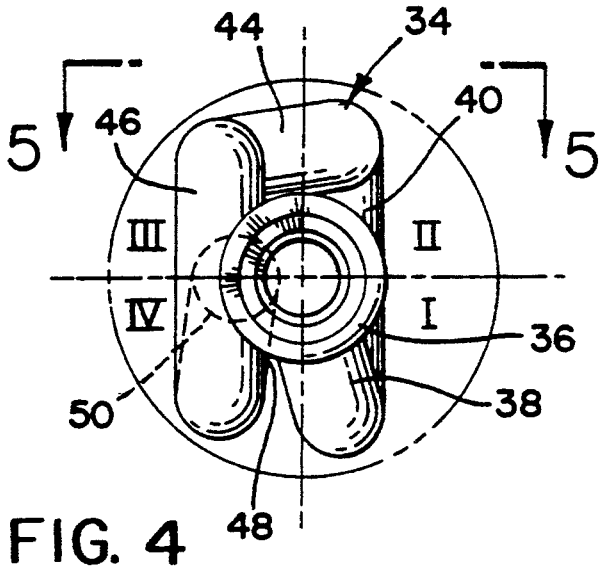
FIG. 4 is top end view of the return tube from the perspective of line 4—4 of FIG. 1.

Referring next to FIGS. 1 and 4, the basic structural framework of the preferred embodiment is a two part cylindrical aluminum canister consisting of a cylindrical wall 24 with a generally circular top end 26 and bottom end 28, which together enclose and define a cylindrical internal volume. It is possible, for purposes of analyzing the subject invention, to divide the internal enclosed volume into four equal, lengthwise quadrants, indicated by the dotted lines in FIG. 4 and numbered I through IV. An evaporator inlet fitting 30 located high on cylindrical wall 24 near top end 26 is adapted to be connected to evaporator line 22. Fitting 30 should be as close to the top as possible, but cannot be directly through top end 26 without risking dumping directly into compressor suction line 12. A compressor outlet fitting 32 through bottom end 28 is adapted to be connected to compressor suction line 12. The two lines 12 and 22 are connected indirectly through a return tube, indicated generally at 34, the details of which are described next.

Figure 2:
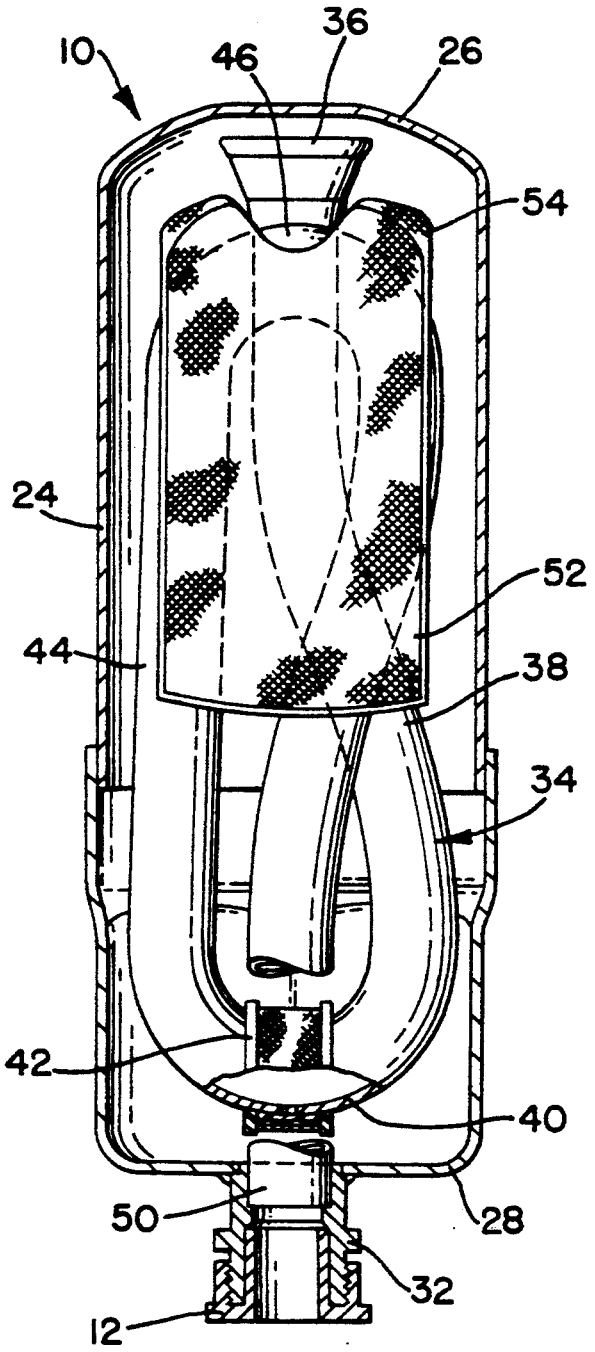
FIG. 2 is a view of the canister similar to FIG. 1, seen from the perspective of line 2—2 of FIG. 1.
Figure 3:
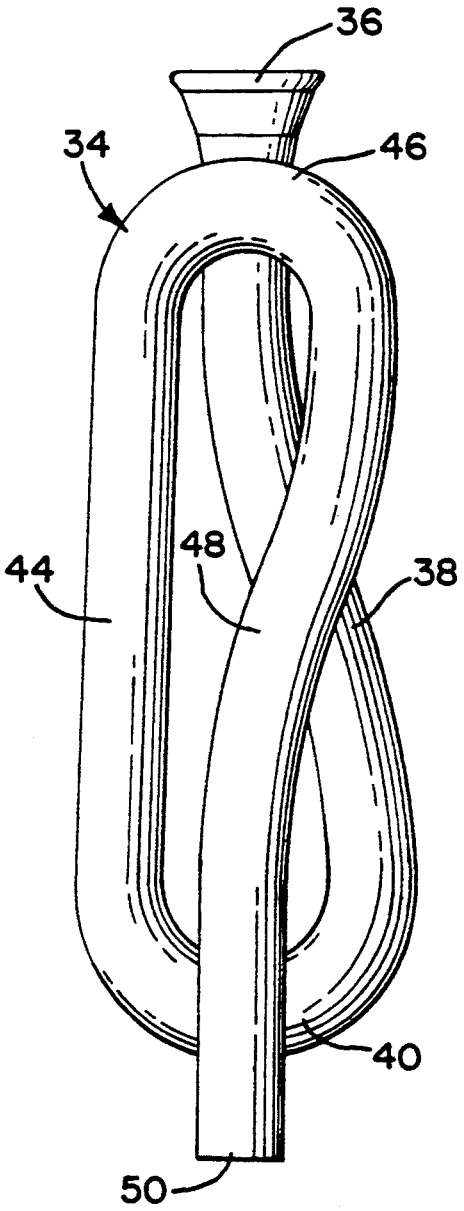
FIG. 3 is a view of the internal return tube alone, seen from the perspective of line 3—3 of FIG. 1.
Figure 6:
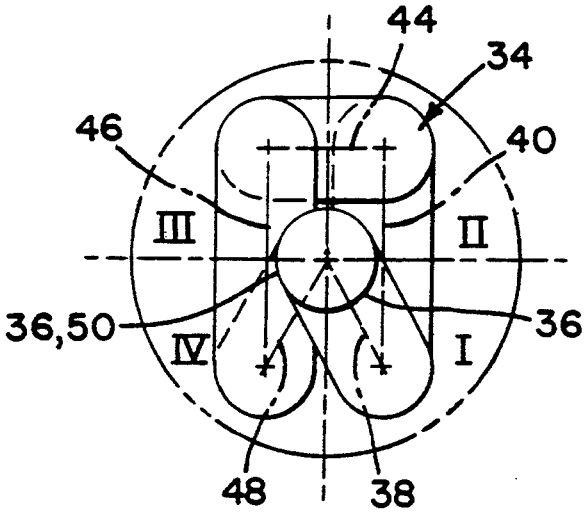
FIG. 6 is a general schematic view similar to FIG. 4.
Figure 5:
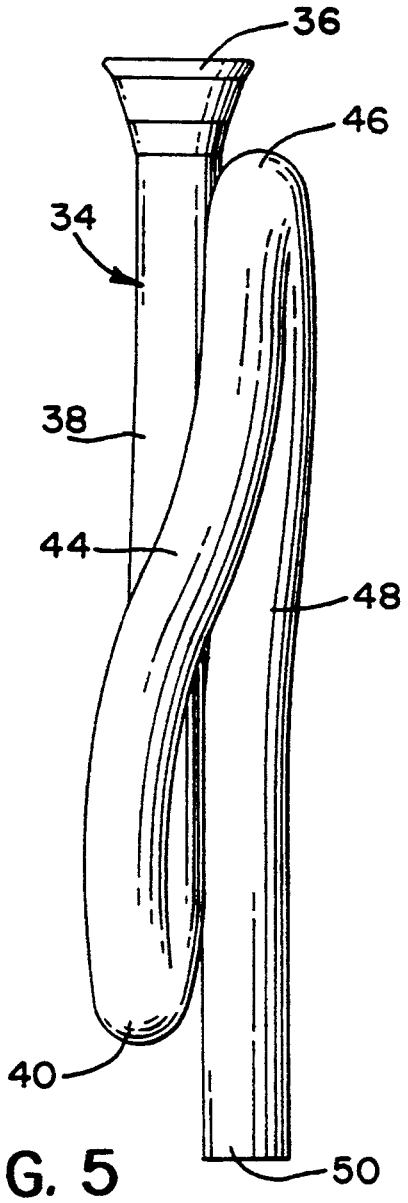
FIG. 5 is a side view of the return tube alone from the perspective of line 5—5 of FIG. 4.

Referring next to FIGS. 2 through 6, return tube 34 is a one piece aluminum tube of substantially constant diameter, which is packaged entirely within the cylindrical internal volume described above. In order to package return tube 34, a very complex shape is necessary, which requires all the views shown to adequately depict. Beginning at the top, return tube 34 has a flared inlet end 36, located just below the canister top end 26, and, as best seen in FIG. 4, substantially on center. Flared upper end 36 has a function described in recently issued, co assigned U.S. Pat. No. 5,179,844. Basically, flared end 36 replaces a separate plastic baffle, but its location here serves an additional function described below. From inlet end 36, tube 34 extends downwardly in a first leg 38 through quadrant I, and extends radially outwardly slightly before merging into a U shaped lower bight 40 located near canister bottom end 28. Lower bight 40 crosses over from quadrant I to II and includes, near its center, a conventional bleed hole assembly 42, not shown in FIGS. 3–5. From lower bight 40, a second leg 44 extends upwardly, initially through quadrant II and transitions, halfway up, to quadrant III. Second leg 44 effectively accomplishes, through its central transition curve, a cross over to the next quadrant, just as bight 40 does, and, therefore, appears foreshortened in the lengthwise view of FIG. 4. Second leg 44 merges into an upper bight 46 located just below flared upper end 36. As best seen in FIG. 3, upper bight 46 is effectively bisected by upper end 36. Upper bight 46 crosses over from quadrant III to quadrant IV, and from there, a third and final leg 48 extends downwardly through quadrant IV, curving back radially inwardly to an extent to a lower outlet end 50. Outlet end 50 fits into suction line fitting 32. FIG. 6 shows the basic pattern followed by the complex bend more simply and schematically, with circles representing beginning, transition and ending points. FIG. 6 also shows the outlet end 50 on center, coincident with inlet end 36. This can be accomplished by shifting lower bight 40 farther away from center, and putting a sharper curve in second leg 44 and third leg 48. What the complex bend pattern illustrated does is to efficiently pack a great deal of tube length into a cylindrical volume no larger than that used with conventional designs. The longer return tube 34 provides operational advantages described below.

Referring again to FIGS. 2 and 6, another structural feature of the invention is illustrated. By packing the various elements of the bend as shown in FIG. 2, the return tube 34 is kept basically within a smaller rectangular prism, indicated by the dotted line, enclosed within the cylindrical volume. This leaves a pair of semi cylindrical empty spaces on either side. A pair of desiccant pouches 52 is attached together by a hinge flap 54. The location of upper bight 46 just below inlet end 36 provides a convenient hanger, allowing the desiccant pouches 52 to be installed with hinge flap 54 resting on upper bight 46 and one pouch 52 located in each of the available residual spaces. No separate fastener is needed. This locates each pouch 52 high within the cylindrical volume, above, or at least partially above, the level of collected liquid, indicated by the dotted line. In operation, when compressor 14 is applying suction to line 12 and to return tube 34, vapor is pulled from the top, through inlet end 36, and through all the twists and turns of return tube 34. This inherently involves more pressure drop than a shorter return tube 34 would, but not enough so as to adversely affect operation. Concurrently, collected liquid, be it refrigerant, or pooled lubricant, or both, is aspirated through bleed hole assembly 42, up second leg 44, around upper bight 46 and down final leg 48, and pulled out in a fine mist form, if not totally vaporized. This keeps the pooled liquid level reduced on a continuing basis, and works basically as a conventional A/D would. However, when compressor 14 is off, the pooled liquid is prevented from draining down through bleed hole assembly 42 by the upper bight 46. No external plumbing trap is needed, as would be the case with a conventional, shorter bottom outlet return tube.

Variations of the disclosed embodiment could be made. As already noted above, by putting the lower outlet end 50 also on center, the whole assembly 10 can be turned about its central axis so as to put the evaporator line fitting 30 at any angular orientation desired. Conventional desiccant bags could be dropped into the lower end of the assembly, instead of the specially designed pouches 52. Or, a single pouch could be hung over the tube upper end 36. However, the particular desiccant arrangement disclosed is particularly advantageous, because of the no fastener installation, the high location made possible by the upper bight 46, and the large desiccant volume in two pouches. Therefore, it will be understood that it is not intended to limit the invention to just the embodiment disclosed.

The embodiments of the invention in which an exclusive property or privilege are claimed are defined as follows:

1. A bottom outlet accumulator/dehydrator for use in a vehicle air conditioning system having an inlet line from an evaporator from which a mixture of liquid and vapor refrigerant is received, and an outlet suction line to a compressor, comprising, a generally cylindrical canister body having top and bottom circular ends and a cylindrical internal volume that is divided into four quadrants, said canister having an connection for said evaporator inlet line located substantially above said bottom end so that liquid refrigerant collects in said internal volume near said bottom end with vapor rising to said top end, a continuous, one piece return tube internal to said canister having a first leg extending downwardly from an open inlet end near said canister top end through a first quadrant to a lower bight located near said bottom end, a second leg extending upwardly from said lower bight through said second quadrant and crossing over to said third quadrant to an upper bight located near said canister top end, and a third leg extending downwardly from said upper bight through said fourth quadrant to a lower outlet end opening through said canister bottom end and connected to said outlet suction line, and, a liquid bleed hole assembly mounted to said lower bight, whereby, when said compressor is on, said suction line draws refrigerant vapor from said canister through said return tube inlet and aspirates collected liquid through said bleed hole assembly, and when said compressor is off, collected liquid is prevented from draining into said suction line by said return tube upper bight.

2. A bottom outlet accumulator/dehydrator for use in a vehicle air conditioning system having an inlet line from an evaporator from which a mixture of liquid and vapor refrigerant is received, and an outlet suction line to a compressor, comprising, a generally cylindrical canister body having top and bottom circular ends and a cylindrical internal volume that is divided into four quadrants, said canister having a connection for said evaporator inlet line located substantially above said bottom end so that liquid refrigerant collects in said internal volume near said bottom end with vapor rising to said top end, a continuous, one piece return tube internal to said canister having a first leg extending downwardly and radially outwardly from an open inlet end near said canister top end center through a first quadrant to a lower bight located near said bottom end, a second leg extending upwardly from said lower bight through said second quadrant and crossing over to said third quadrant to an upper bight located near said canister top end, and a third leg extending downwardly and radially inwardly from said upper bight through said fourth quadrant to a lower outlet end opening near said canister bottom center end and connected to said outlet suction line, and, a liquid bleed hole assembly mounted to said lower bight, whereby, said canister may be vertically oriented with said evaporator inlet line connection oriented in any angular position desired, and when said compressor is on, said suction line draws refrigerant vapor from said canister through said return tube inlet and aspirates collected liquid through said bleed hole assembly, and when said compressor is off, collected liquid is prevented from draining into said suction line by said return tube upper bight.

3. A bottom outlet accumulator/dehydrator for use in a vehicle air conditioning system having an inlet line from an evaporator from which a mixture of liquid and vapor refrigerant is received, and an outlet suction line to a compressor, comprising, a generally cylindrical canister body having top and bottom circular ends and a cylindrical internal volume that is divided into four quadrants, said canister having an connection for said inlet line located substantially above said bottom end so that liquid refrigerant collects in said internal volume near said bottom end with vapor rising to said top end, a continuous, one piece return tube internal to said canister having a first leg extending downwardly from an open inlet end near said canister top end through a first quadrant to a lower bight located near said bottom end, a second leg extending upwardly from said lower bight through said second quadrant and crossing over to said third quadrant to an upper bight located just below said inlet end, and a third leg extending downwardly from said upper bight through said fourth quadrant to a lower outlet end opening through said canister bottom end and connected to said outlet suction line, a liquid bleed hole assembly mounted to said lower bight, and a desiccant pouch hung over said return tube upper end and resting on said upper bight, substantially above the level of collected liquid, whereby, when said compressor is on, said suction line draws refrigerant vapor from said canister through said return tube inlet and aspirates collected liquid through said bleed hole assembly, and when said compressor is off, collected liquid is prevented from draining into said suction line by said return tube upper bight.

* * * * *